US006385914B2

(12) United States Patent
Alley

(10) Patent No.: US 6,385,914 B2
(45) **Date of Patent: *May 14, 2002**

(54) INSERT FOR MOUNTING BLOCK OF SNOW GUARD SYSTEM

(76) Inventor: F. William Alley, Gebbie Rd., Greensboro, VT (US) 05841

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/397,938

(22) Filed: Sep. 17, 1999

(51) Int. Cl.[7] ..... E04D 13/10
(52) U.S. Cl. ..... 52/25
(58) Field of Search ..... 52/24, 25, 26, 52/462, 465, 469, 716.8

(56) References Cited

U.S. PATENT DOCUMENTS

| | | | | | |
|---|---|---|---|---|---|
| 3,981,118 | A | * | 9/1976 | Johnson et al. | |
| 4,546,586 | A | * | 10/1985 | Knudson | |
| 5,613,328 | A | * | 3/1997 | Alley | 52/25 |
| 5,732,513 | A | * | 3/1998 | Alley | 52/25 |
| 5,901,507 | A | * | 5/1999 | Smeja et al. | 52/24 |

* cited by examiner

*Primary Examiner*—Robert Canfield
(74) *Attorney, Agent, or Firm*—Burr & Brown

(57) ABSTRACT

A mounting block for a snow guard system having a groove formed in the base. An insert is placed into the groove. The insert has an outer periphery that conforms to the shape of the groove and has an inner periphery that conforms to the shape of the metal roof seam. Set screws or similar clamping devices are provided to secure the mounting block to the seam. The insert is manufactured from a material that is non-corrosive, preferably plastic.

10 Claims, 3 Drawing Sheets

INSERT FOR MOUNTING BLOCK OF SNOW GUARD SYSTEM

BACKGROUND OF THE INVENTION

1. Field of the Invention

The present invention relates generally to a snow guard system capable of being attached to a roof, the system used to prevent snow from sliding off the roof. Specifically, the present invention relates to an improved mounting block for securing such snow guard systems to a roof seam.

2. Related Art

In areas of the world where there are significant amounts of snowfall, it is typical for large amounts of snow to accumulate on rooftops. When large amounts of snow accumulate on rooftops, a hazardous situation can be created by changing weather conditions such as high winds or prolonged periods of cooling and warming. Under these and other conditions, the snowpack undergoes physical changes that promotes a situation wherein the snowpack will slide off of a sloped roof. These hazardous conditions can cause the accumulated snowpack to slide off the roof and cause damage to surrounding property, landscaping, and in some cases the sliding snow can cause serious bodily injury. The problem of sliding snow is particularly prevalent in metal roofs. Metal roofs provide building structures with many advantages such as strength and durability, but the metal tends to absorb environmental heat which can exacerbate the conditions that lead to snow slides. Also, metal roofs provide relatively little surface friction to a snow pack which can also lead to snow slides.

Snow guard systems have long been used for preventing movement of snow and ice across selected areas of roofs. An example of snow guard systems can be found in U.S. Pat. No. 42,972 to Howe, which issued May 31, 1864. Another example of one such snow guard system is discussed in Applicant's U.S. Pat. No. 5,613,328, the entirety of which is incorporated herein by reference. Another example is discussed in U.S. Pat. No. 5,732,513 which is also owned by Applicant and is incorporated herein by reference.

It is known that metal roofs with raised seams present particular problems associated with the attachment of snow guards. A typical metal roof comprises a plurality of metal roofing panels that are laid side by side to cover the width of a roof section. Each panel usually includes substantially perpendicular edges running along both the left and right sides. The roofing panels are located such that their edges abut and form a seal therebetween. The perpendicular edges of the abutting panels are each crimped together and/or bent downwardly over each other to form a joint. The joint serves to seal the abutting panels and thereby prevents fluid communication to the areas underneath the roof panels. While maintaining the primary purpose of preventing leakage to the area below the panels, the joint can be formed into various patterns for decorative purposes, with the cross sections having, for example, dome shapes or polygonal shapes.

The methods of attachment of snow guard systems to metal roof seams have historically presented some problems. One method of attaching the systems is to use a mounting block that is secured to the seam using bolts or screws. However, this method requires puncturing the roofing seam which leads to a destruction of the hermeticity of the metal roof. As described in U.S. Pat. No. 5,613,328, a method of securing the mounting block to the metal roof seam is disclosed that utilizes a system of set screws that do not puncture the roofing seam. In U.S. Pat. No. 5,732,513, a second method of securing the mounting block to the metal roof seam without puncturing the seam is disclosed. The second method utilizes a mounting block having a chamber and cam system to engage the seam. Another method of securing the mounting block to the metal roof seam is disclosed in pending application Ser. No. 09/340,501, entitled Snow Guard System Having Mounting Block and Clamping Pad for Securing to a Roof Seam, Attorney Docket No. 820_015, which was filed on Jun. 30, 1999 and which is owned by the same Applicant as the present invention and is incorporated entirely herein by reference.

Although the methods of securing the mounting block heretofore disclosed are adequate to carry out their intended objectives, there still remains some problems associated with mounting the snow guard assembly to the metal roof. The metal roof seam and the metal snow guard are both exposed to high degrees of moisture which can lead to corrosion caused by the contact of the metal seam and the metal groove in the mounting block. The corrosion is a result of a galvanic reaction between the metal roof, typically copper, and the metal groove in the mounting block, typically aluminum. The corrosion can lead to many deleterious conditions, including unsightly deposits on the roof panels and a weakening of the coupling between the seam and snow guard assembly. The corrosion could eventually lead to a destruction of the hermeticity of the metal roof.

Additionally, as mentioned above, the metal roof seam can be formed in various geometrical shapes. The variety of seam shapes requires the mounting blocks to be manufactured in numerous configurations with grooves that match the geometrical shape of the seams. The number of shapes of the metal roof seam is limited only by the ingenuity and artistic flair of the roof manufacturer and/or installer. The result is that the manufacturer of metal roof snow guard assemblies cannot manufacture only one configuration of the mounting block, rather the manufacturer must in some instances custom build mounting blocks for the particular application. This situation obviously leads to an increase in the cost of manufacture of the snow guard assemblies.

Thus, it would be desirable to have a snow guard system that prevents corrosion of the roof and snow guard assembly. It would also be desirable to have a snow guard system having mounting assemblies that are configurable to various geometrically-shaped metal roof seams. Further, it would be desirable to standardize the manufacture of the major components of the snow guard assembly and thereby reduce the cost of manufacture of the system.

SUMMARY OF THE INVENTION

It is therefore an object of the invention to improve upon the prior art snow guard systems described above.

It is another object of the invention to prevent corrosion of the metal roof, particularly the metal roof seam.

It is yet another object of the invention to standardize the production of one of the major components of the snow guard system.

These and other objects are obtained by providing a mounting block for a snow guard system having a groove formed in the base. An insert is placed into the groove. The insert has an outer periphery that conforms to the shape of the groove and has an inner periphery that conforms to the shape of the metal roof seam. Set screws or similar clamping devices are provided to secure the mounting block to the seam. The insert is manufactured from a material that is non-corrosive, preferably plastic.

Additional objects, advantages, and other novel features of the invention will become apparent to those skilled in the art upon examination of the detailed description and drawings that follow.

DETAILED DESCRIPTION OF THE INVENTION

Figure 1:
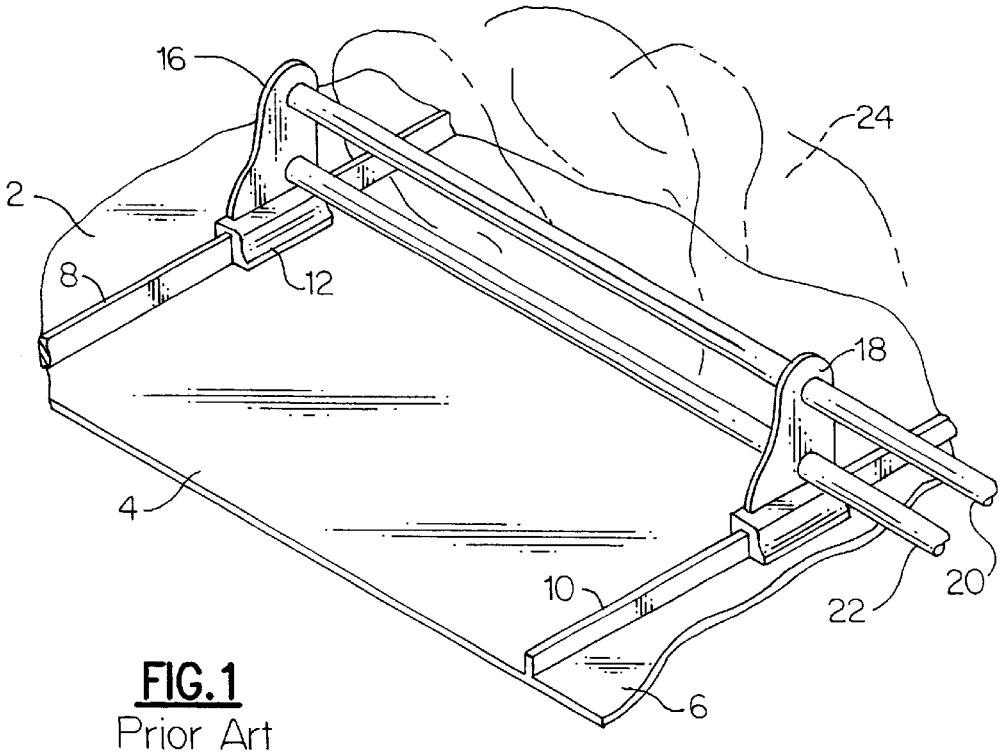
FIG.1 Prior Art
FIG. 1 shows a prior art snow guard system for attachment to a seamed metal roof.

Turning now to FIG. 1, a snow guard system is shown mounted to a metal roof. The metal roof comprises a plurality of metal roofing panels 2, 4, 6 that substantially cover the subroof substructure (not shown). The panels 2,4,6 are arranged so that their edges abut and the edges are crimped together or bent downwardly over each other to form a joint or seam 8, 10. The seam seals the adjoining panels and thereby prevents fluid communication to the roofing substructure. The snow guard comprises mounting assemblies 12, 14 that include grooves located in the base thereof. The mounting assemblies 12, 14 are locateable on the metal roof by placing the groove about a segment of the seam 8, 10. The mounting assemblies 12, 14 include brackets 16, 18 which have a plurality of holes located therein to accept pipes 20, 22. The pipes 20, 22 secure snow 24 which has accumulated on the roof, thereby preventing the snow from falling off the roof.

Figure 2:
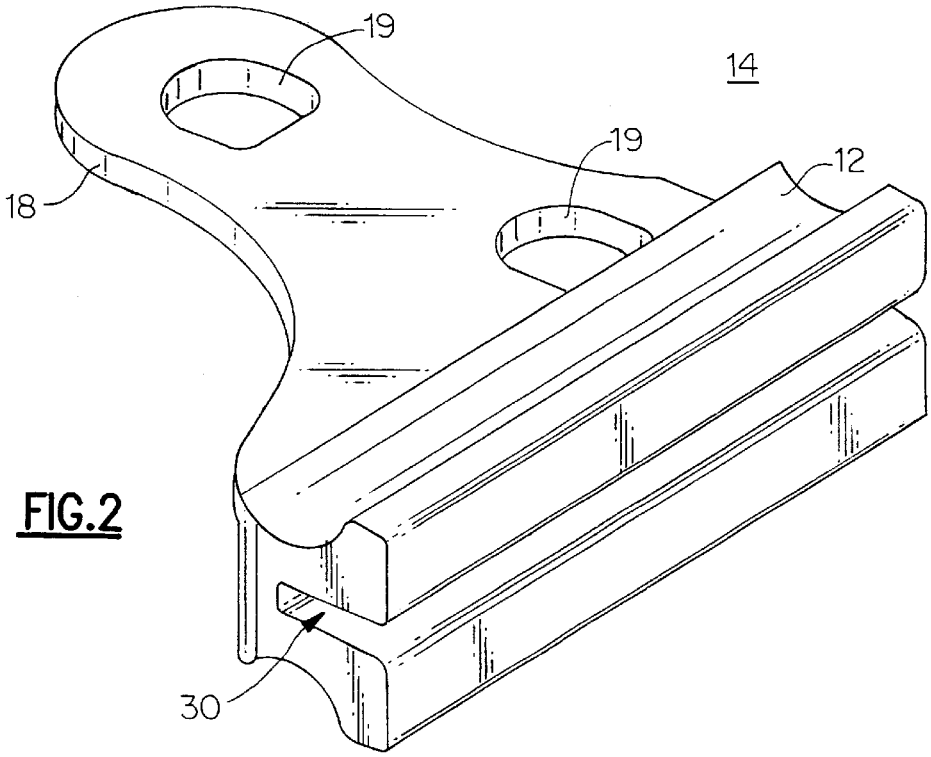
FIG. 2 shows a perspective view of a prior art mounting assembly for a snow guard attachment system.

Referring now to FIG. 2, a mounting assembly 14 is shown that includes a mounting block 12 which is typically manufactured from aluminum. Attached to the block 12 is a bracket 18 having a plurality of holes 19 located therein to accept pipes 20, 22. The block 15 includes a groove 30 located on the base. The groove 30 is configured to be mounted about a substantially rectangular metal roof seam 10. The groove 30 extends along the entire length of the block 15. The block 15 is coupled to the seam 10 using coupling means that would be apparent to one skilled in the art, such as those discussed and disclosed above.

The configuration of the groove 30 in FIG. 2 is rectangular, which is complementary to the configuration of the seam 10. As mentioned above, the configuration of the seam 10 can have many different cross-sectional profiles. In the prior art, if the cross-sectional configuration of the seam 10 is substantially spherical or dome-shaped, the groove 30 must be precisely configured to complement that shape in order to ensure a good fit and adequate coupling of the block to the roof.

Figure 3:
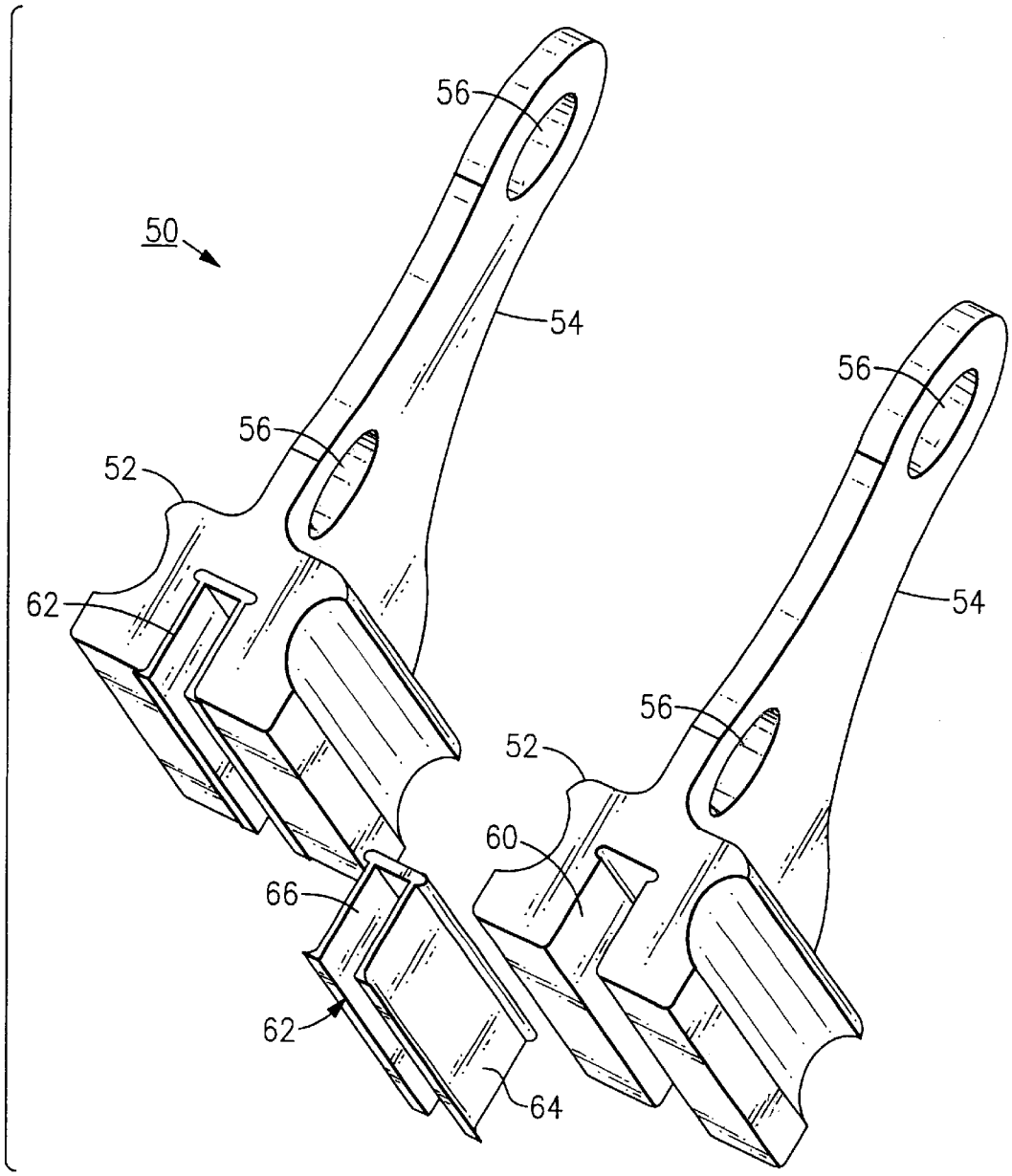
FIG. 3 shows an exploded perspective view of a mounting assembly for a snow guard attachment system that embodies the present invention.
Figure 4:
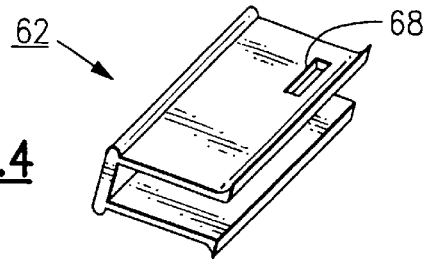
FIG. 4 shows a perspective view of an insert for a mounting block of a snow guard assembly that embodies the present invention.

Referring now to FIG. 3, there is shown a mounting assembly 50 that embodies the present invention. The mounting assembly 50 includes a mounting block 52. The mounting block 50 is preferably formed from aluminum. The mounting block 52 has a bracket 54 attached to the top surface of the block 50. The bracket 54 includes holes 56 formed therein that are shaped to accept poles (not shown) to retain the snow on the roof. The mounting block 52 has a rectangular groove 60 formed in its base. The groove 60 is capable of accepting an insert 62 that is formed of a material that will not galvanically react with the metal roof seam, and preferably the material is a hard plastic such as an extruded polypropylene. The insert 62 has an outer periphery 64 that is formed to exactly conform with the groove 60 and has an inner periphery 66 that is formed to exactly conform to the metal roof seam. As shown in FIG. 4, the insert 62 can be adapted to include a hollowed-out portion 68 to allow for the clamping means to pass therethrough thus ensuring maximum coupling forces are present between the mounting block and the metal roof seam.

Figure 5:
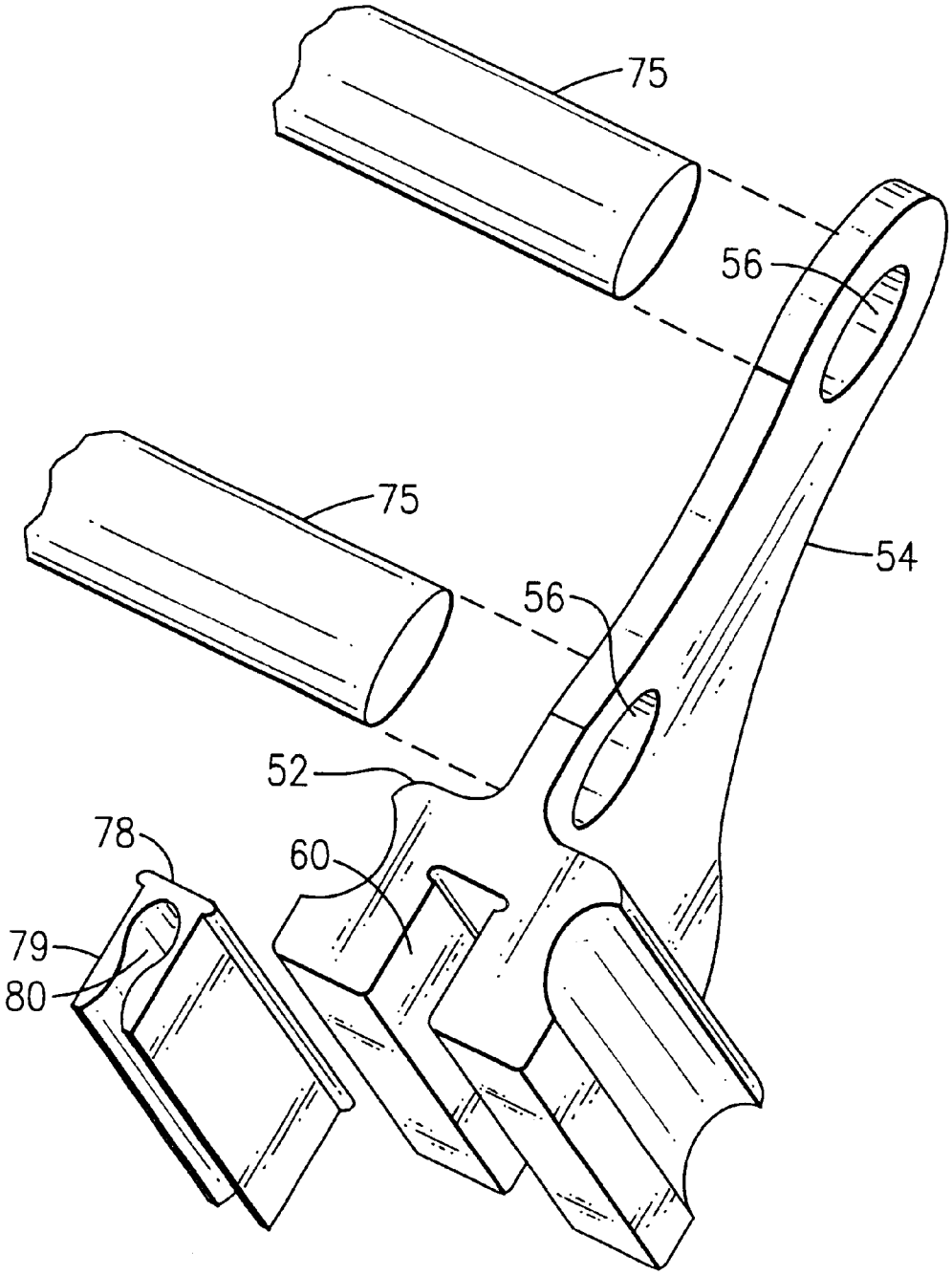
FIG. 5 is a cross-sectional view of a mounting assembly for snow guard attachment systems that embodies the present invention.

Turning now to FIG. 5, there is depicted a mounting block 52 that has an attached bracket 54 with holes 56 for receiving snow-retaining pipes 75. The mounting block 52 has a groove 76 that is formed in the base. An insert 78 is provided that has an outer periphery 79 that exactly conforms to the rectangular shape of the groove 60. The insert 78 has an inner periphery 80 that conforms to the shape of the metal roof seam, which in this case has a spherical cross-sectional shape. Of course, one skilled in the art recognizes that the cross-sectional shape of the seam can be any of a number of shapes.

The present invention allows the manufacturer to produce mounting blocks with standard shaped and sized grooves. The grooves interact with plastic inserts that are formed to the exact shape of a particular roof seam. In this way, the metal mounting blocks do not have adverse galvanic reactions with the metal roof seam and the plastic inserts can be formed to the exact shape required by the particular roof seam.

While the present invention has been particularly shown and described with reference to the preferred mode as illustrated in the drawings, it will be understood by one skilled in the art that various changes in detail may be effected therein without departing from the spirit and scope of the invention as defined by the claims.

I claim:

1. A mounting assembly for puncture free attachment of a snow guard system to a roof seam, said assembly comprising:

a mounting block having a groove formed therein;

a non-corrosive, one-piece insert positioned within said groove, said insert having an inner periphery and an outer periphery, at least a portion of said inner periphery defining a substantially centrally located recess, said outer periphery having a shape substantially complementary to said groove;

means for securing said mounting block to said roof seam, wherein relative movement between said mounting block and said seam is prevented; and a mounting bracket coupled to said mounting block, said mounting bracket including at least one hole for mounting a pipe therein.

2. The mounting assembly as recited in claim 1, wherein said insert is received within said groove in an interlocking fashion.

3. The mounting assembly as recited in claim 2, wherein said groove includes an upper portion and side portions, said upper portion of said groove including a transverse slot for receiving complementary ridges formed on an upper portion of said insert.

4. The mounting assembly of claim 1 wherein said insert is formed from polypropylene.

5. A mounting assembly for puncture free attachment of a snow guard system to a roof seam, said assembly comprising:

a mounting block having a groove formed therein;

a non-corrosive, one-piece insert positioned within said groove, said insert having an inner periphery and an outer periphery, at least a portion of said inner periphery defining a substantially centrally located recess, said outer periphery having a shape substantially complementary to said groove, said insert further comprising at least one hollowed out portion passing from said outer periphery to said inner periphery; and means for securing said mounting block to said roof seam, said means passing through said hollowed out portion to directly interact with the seam, wherein relative movement between said mounting block and said seam is prevented.

6. A method for preventing corrosion between a metal roof seam and a snow guard assembly positioned thereon, said method sequentially comprising the steps of:

(a) providing a snow guard mount designed to be secured to the roof seam, said snow guard mount having a seam-receiving groove;

(b) positioning a non-corrosive insert within said groove; and (c) securing said mount including said insert to the roof seam.

7. The method for preventing corrosion between a metal roof seam and a snow guard assembly positioned thereon as recited in claim 6, wherein said insert is formed from polypropylene.

8. The method for preventing corrosion between a metal roof seam and a snow guard assembly positioned thereon as recited in claim 6, wherein said assembly further comprises a mounting bracket coupled to said mounting block.

9. The method for preventing corrosion between a metal roof seam and a snow guard assembly positioned thereon as recited in claim 8, wherein said bracket includes at least one hole for mounting a pipe therein.

10. The method for preventing corrosion between a metal roof seam and a snow guard assembly positioned thereon as recited in claim 6, wherein said insert includes at least one hollowed out portion to allow said means for securing the block directly to interact with the seam.

* * * * *